United States Patent [19]

Neuhold et al.

[11] Patent Number: 4,612,754

[45] Date of Patent: Sep. 23, 1986

[54] METHOD OF INSERTING A SLIDE INTO A FRAME

[75] Inventors: Arnold Neuhold, Farchant; Claus Pohl, Eschenlohe, both of Fed. Rep. of Germany

[73] Assignee: Geimuplast Peter Mundt GmbH & Co. KG, Farchant, Fed. Rep. of Germany

[21] Appl. No.: 721,465

[22] Filed: Apr. 9, 1985

[30] Foreign Application Priority Data

Apr. 13, 1984 [DE] Fed. Rep. of Germany ..... 3414021

[51] Int. Cl.[4] ..... B65B 61/20; B65B 63/00

[52] U.S. Cl. ..... 53/457; 53/266 R; 53/435

[58] Field of Search ..... 53/266 R, 266 C, 435, 53/457, 492, 520; 156/108

[56] References Cited

U.S. PATENT DOCUMENTS

| | | | |
|---|---|---|---|
| 3,470,642 | 10/1969 | Mundt et al. | 53/266 C |
| 3,521,423 | 7/1970 | Koeppe et al. | 53/435 |
| 4,528,795 | 7/1985 | Stemmer et al. | 53/266 R |

*Primary Examiner*—E. R. Kazenske
*Assistant Examiner*—Michael D. Folkerts
*Attorney, Agent, or Firm*—Fleit, Jacobson, Cohn & Price

[57] ABSTRACT

A method of inserting a slide into a frame of elastic plastic, including expanding the frame at two opposite edges. Inserting of the slide and/or the fixing of the slide in position relative to the picture gate is facilitated in that the frame is expanded at both of two opposed edges as the slide is inserted. The slide which has been inserted to its position for projection is fixed with utilization of the elasticity of the plastic in that the expanding of the frame is terminated.

7 Claims, 4 Drawing Figures

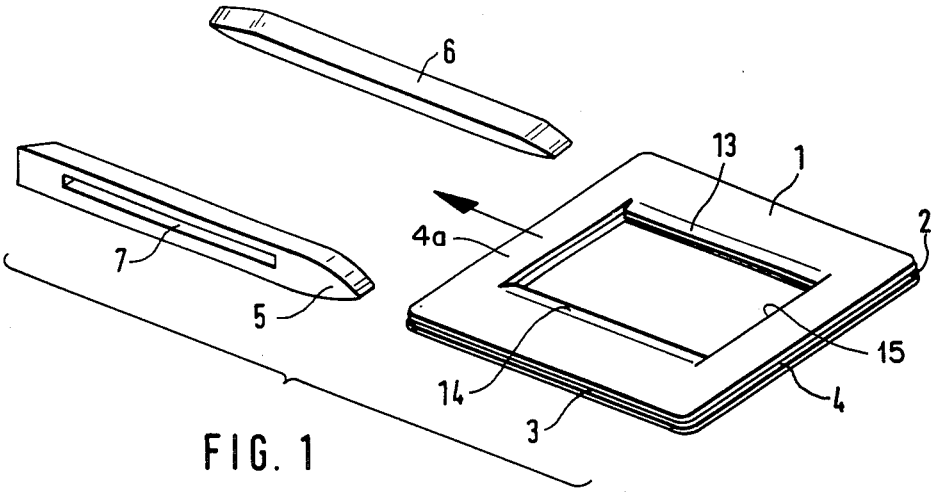
FIG. 1
FIG. 2
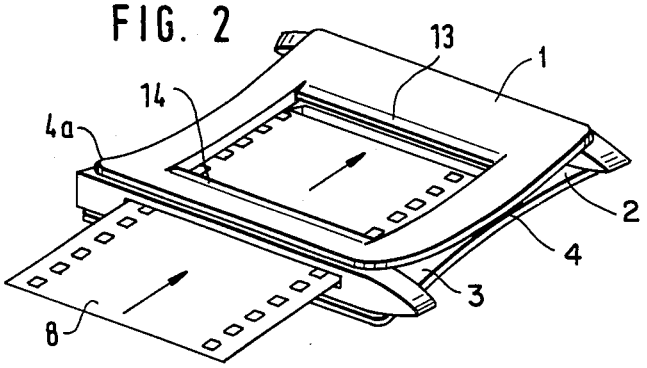

METHOD OF INSERTING A SLIDE INTO A FRAME

BACKGROUND OF THE INVENTION

1. Field of the Invention

This invention relates to a method of inserting a slide into a frame of elastic plastic, comprising expanding said frame on two opposite sides.

2. Description of the Prior Art

German Patent Specification No. 1,214,898 and corresponding U.S. Pat. No. 3,341,960 show in FIG. 8, and in FIG. 14, respectively, a slide frame having an entrance slot which merges without a transition into a tubular pocket for receiving the slide. The tubular pocket defines not only one entrance slot at one end but also another entrance slot at the opposite end. To hold the slide in the tubular pocket, limiting cams and grooves are provided at the top and bottom sides. Limiting cams and grooves are provided for lateral guidance of the slide. Further means for guiding the slide being inserted comprise bores, through which pins of a mounting machine are inserted to provide stops for guiding the slide.

In the remaining embodiments in the printed publications mentioned above each slide frame is formed with a pocket that is closed at one end so that additional features are required to permit a movement of the slide to a position for projection, i.e., to the closed end of the pocket, in spite of the inevitable deflection of the slide. That additional feature resides in that that end of the picture gate which is opposite to the entrance slot is beveled in an outward direction. In plastic frames which are made by extruding, stamping and glueing, the additional feature resides in that that edge of the picture gate which is opposite to the entrance slot is V-shaped in the plane of a plastic sheeting.

SUMMARY OF THE INVENTION

It is an object of the invention so to improve the known method that the additional features described hereinbefore are no longer required.

This object is accomplished in that the inserting of the slide and/or the fixing of the slide in position relative to the picture gate is facilitated in that the frame is expanded at both of two opposed edges as the slide is inserted, and the slide which has been inserted to its position for projection is fixed by utilizing the elasticity of the plastic in that the expanding of the frame is terminated.

The advantage afforded by the process in accordance with the invention resides in that the slide frame can be inserted as far as to its position for projection in spite of the inevitable deflection of the slide and without a need for additional measures, and that this can be effected in known slide mounting machines and regardless of whether the slide frame has been made by injection molding or by extruding and stamping.

BRIEF DESCRIPTION OF THE DRAWING

FIGS. 1 and 2, respectively, show a slide frame before and after the insertion of a slide.

DETAILED DESCRIPTION OF THE PREFERRED EMBODIMENTS

Figure 3:
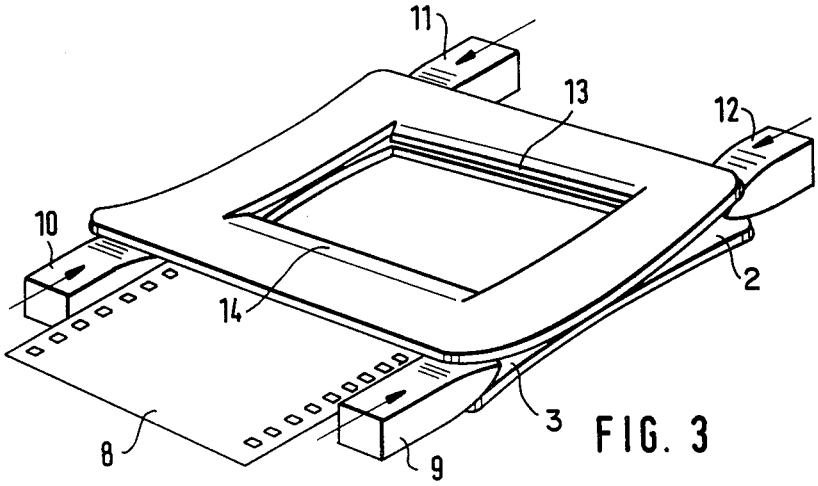
FIG. 3 shows another frame during the insertion of a slide in accordance with a modified embodiment of the method.
Figure 4:
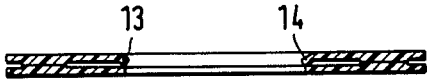
FIG. 4 is a sectional view showing a frame which can be used in carrying out the process in accordance with the invention.

Various illustrative embodiments of the invention will be subsequently described.

As is apparent from FIG. 2, the slide frame 1 made of elastic plastic is adapted to be expanded at each of two opposite edges. As is apparent from FIGS. 1 and 2 the entrance slots 2, 3 extend laterally inwardly partially along the opposite side members, e.g., 4, 4*a* of the frame to form a continuous rectangular gap along each edge and which extends across the width of the frame. In the embodiment shown in FIGS. 1 and 2, wedges 5, 6 are inserted from the side members 4, 4*a* of the frame 1 into the continuous gap formed by the entrance slots 2, 3. The wedge 5 is formed with a through opening 7, which constitutes a passage for the slide 8. The direction in which the slide 8 is inserted is indicated in FIG. 2 by two arrows.

The embodiment shown in FIG. 3 differs from the one described hereinbefore in that wedges 9 to 12 are inserted into the entrance slots 2,3 in the direction of the arrows shown, i.e., in the direction in which the slide is inserted, or in the opposite direction.

In both embodiments the wedges are automatically inserted into the entrance slots.

Antipopping ribs 13, 14 are emphasized in FIGS. 1, 2, 3 and 4.

It is stated in conclusion that the invention ensures that the film will be gripped. The gripping of the film serves two purposes:

1. The film is fixed in position in the frame. This is accomplished in that the film bed is constricted and the film is gripped between two of the boundary surfaces of the picture opening 15.

2. The gripping imparts to the film an initial camber so that an antipop effect is achieved.

We claim:

1. A method of inserting a slide into a slide frame of elastic plastic material, said method comprising the following steps:

(a) providing a generally rectangular slide frame that includes a pair of slots extending along each of a pair of opposed edges, the frame having a picture opening that includes antipopping ribs along at least two opposed edges of the opening for cooperatively engaging a slide between the ribs and internal surfaces of the frame;

(b) inserting wedges into each of the slots to enlarge the slots and to space the antipopping ribs from the internal surfaces of the frame;

(c) inserting a slide laterally into one of the enlarged slots to position the slide relative to the picture opening in the frame; and (d) removing the wedges from the slide frame.

2. A method according to claim 1, wherein the slot into which the slide is inserted extends laterally along the frame and along side members of the frame to form a gap which extends throughout the width of the frame.

3. A method according to claim 1, wherein said insertion step includes inserting said wedges into the slots in the same direction in which the slide is inserted.

4. A method according to claim 1, wherein said inserting step includes inserting single wedges into and along each slot.

5. A method according to claim 4, wherein one of the wedges includes a through opening substantially aligned with the slot into which it passes to permit the insertion of a slide through the opening.

6. A method according to claim 1, wherein said inserting step includes providing a pair of wedges at respective ends of each slot and movable in a direction transverse to an opening defined by each slot to enlarge the slots, the lateral spacing of at least one pair of wedges being sufficient to permit a slide to pass therebetween and into the enlarged slot.

7. A method according to claim 1, wherein said inserting step is performed by inserting the slide in a direction transverse to the edges of the picture opening that include antipopping ribs.

* * * * *